US007120947B1

(12) United States Patent
Magallanes

(10) Patent No.: US 7,120,947 B1
(45) Date of Patent: Oct. 17, 2006

(54) BACK MASSAGING AND CLEANING DEVICE

(76) Inventor: Octavio Magallanes, 3502 Skyline Dr., Riverside, CA (US) 92509

( * ) Notice: Subject to any disclaimer, the term of this patent is extended or adjusted under 35 U.S.C. 154(b) by 0 days.

(21) Appl. No.: 11/360,339

(22) Filed: Feb. 24, 2006

(51) Int. Cl.
*A47K 7/02* (2006.01)

(52) U.S. Cl. ..... 4/606; 601/134

(58) Field of Classification Search ..... 4/605, 4/606; 15/104.92; 601/134
See application file for complete search history.

(56) References Cited

U.S. PATENT DOCUMENTS 3,478,369 A * 11/1969 Ensley ..... 4/606
3,875,604 A 4/1975 Wurn et al.
4,417,362 A 11/1983 Walker
4,421,110 A * 12/1983 DeLisle et al. ..... 601/134
5,239,712 A 8/1993 Kinder
5,345,640 A 9/1994 Goss
5,774,907 A * 7/1998 Doggwiler ..... 4/606
D450,158 S 11/2001 Swann
6,427,279 B1 * 8/2002 White et al. ..... 4/606
6,775,864 B1 8/2004 Cannetti

* cited by examiner

*Primary Examiner*—Tuan Nguyen

(57) ABSTRACT

A back massaging and cleaning device for scrubbing and massaging a back of a person taking a shower includes a massager having a front wall, a rear wall and a perimeter wall extending between and being attached to the front and rear walls to define an interior space. The front wall has a plurality of outwardly extending protuberances to massage a back of a person. A soap dispenser is coupled to the massager and is configured to receive soap and be in fluid communication with a water source. The soap dispenser supplies soap and water to the interior space. Each of a plurality of brushes is coupled to the front wall and is in fluid communication with the interior space to permit soap and water in the interior space to be applied to the back to scrub the back when the front wall receives the back.

12 Claims, 4 Drawing Sheets

BACK MASSAGING AND CLEANING DEVICE

BACKGROUND OF THE INVENTION

1. Field of the Invention

The present invention relates to shower back scrubbers and more particularly pertains to a new shower back scrubber for scrubbing and massaging a back of a person taking a shower.

2. Description of the Prior Art

The use of shower back scrubbers is known in the prior art. U.S. Pat. No. 3,875,604 describes a system for providing a water fed brush that rotates while oscillating vertically which can be easily stopped by the person applying too much pressure to the brush. Another type of shower back scrubber is U.S. Pat. No. 5,239,712 for providing an upper rotating disk and a lower oscillating brush to scrub the back of the user which provides electrical motors to actuate the disk and brush in a liquid environment which could lead to a shock of the user. Another type of shower back scrubber is U.S. Pat. No. 6,775,864 for providing an impeller coupled to brushes so that the brushes are rotated when the impeller receives water, which can be easily stopped by excessive pressure applied to the brushes by a user.

While these devices fulfill their respective, particular objectives and requirements, the need remains for a device that includes certain improved features that allows the user to put as much pressure as necessary against the device to allow for a deep massage of the back of the user.

SUMMARY OF THE INVENTION

The present invention meets the needs presented above by generally comprising a massager having a front wall, a rear wall and a perimeter wall extending between and being attached to the front wall and the rear wall to define an interior space. The front wall has a plurality of protuberances extending outwardly from the front wall. The protuberances are configured to be rubbed against a back of a person to massage the back. A soap dispenser is positioned in the interior space of the massager. The soap dispenser is configured to receive soap and is in fluid communication with a water source. The soap dispenser supplies soap and water to the interior space when the soap dispenser receives water from the water source. Each of a plurality of brushes is coupled to the front wall of the massager. Each of the brushes is in fluid communication with the interior space to permit soap and water in the interior space to be applied to the back. The brushes scrub the back when the front wall receives the back.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
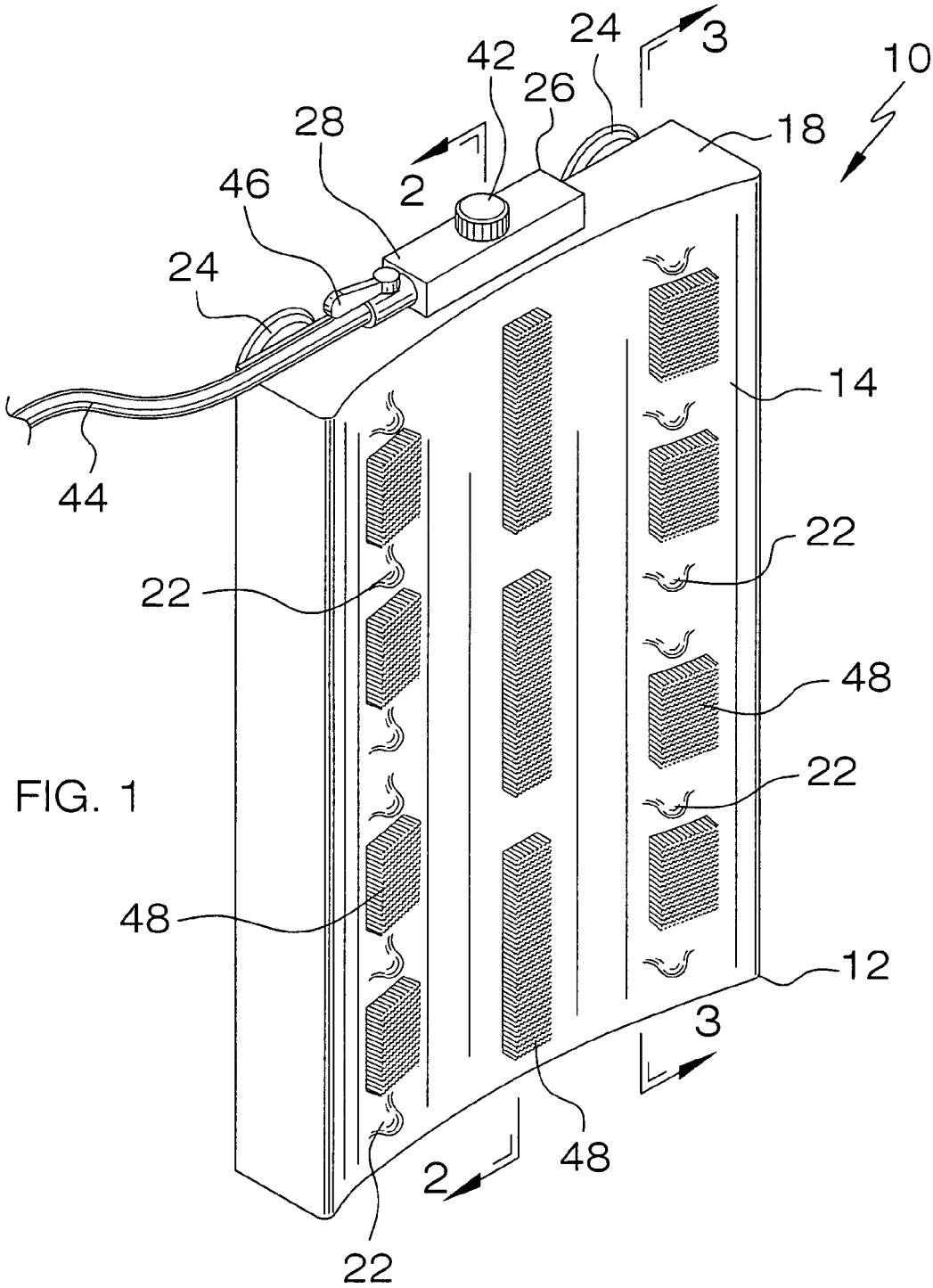
FIG. 1 is a perspective view of a back massaging and cleaning device according to the present invention.
Figure 2:
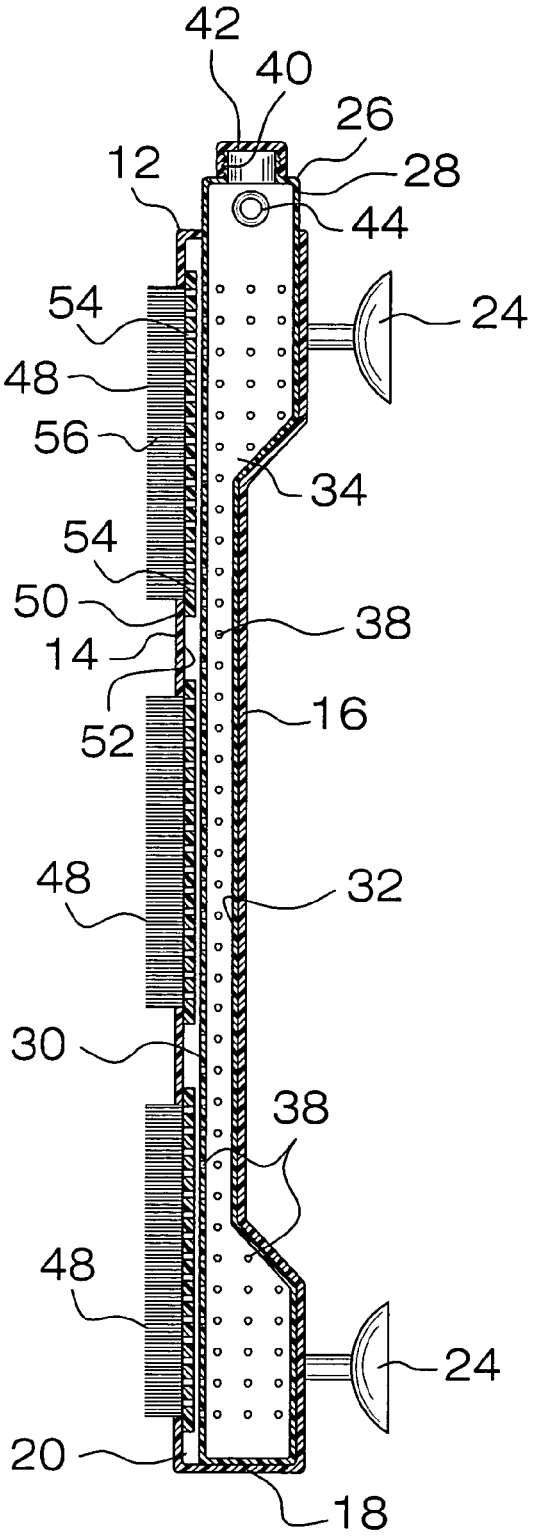
FIG. 2 is a cross-sectional view of the present invention taken along line 2—2 of FIG. 1.
Figure 3:
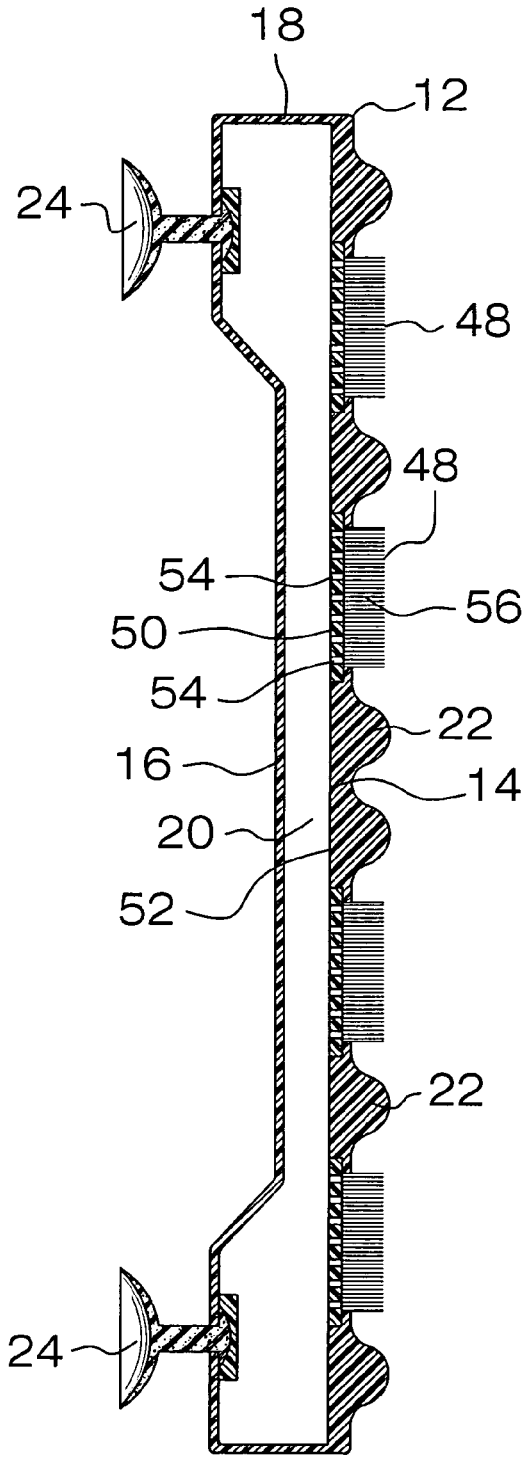
FIG. 3 is a cross-sectional view of the present invention taken along line 3—3 of FIG. 1.
Figure 4:
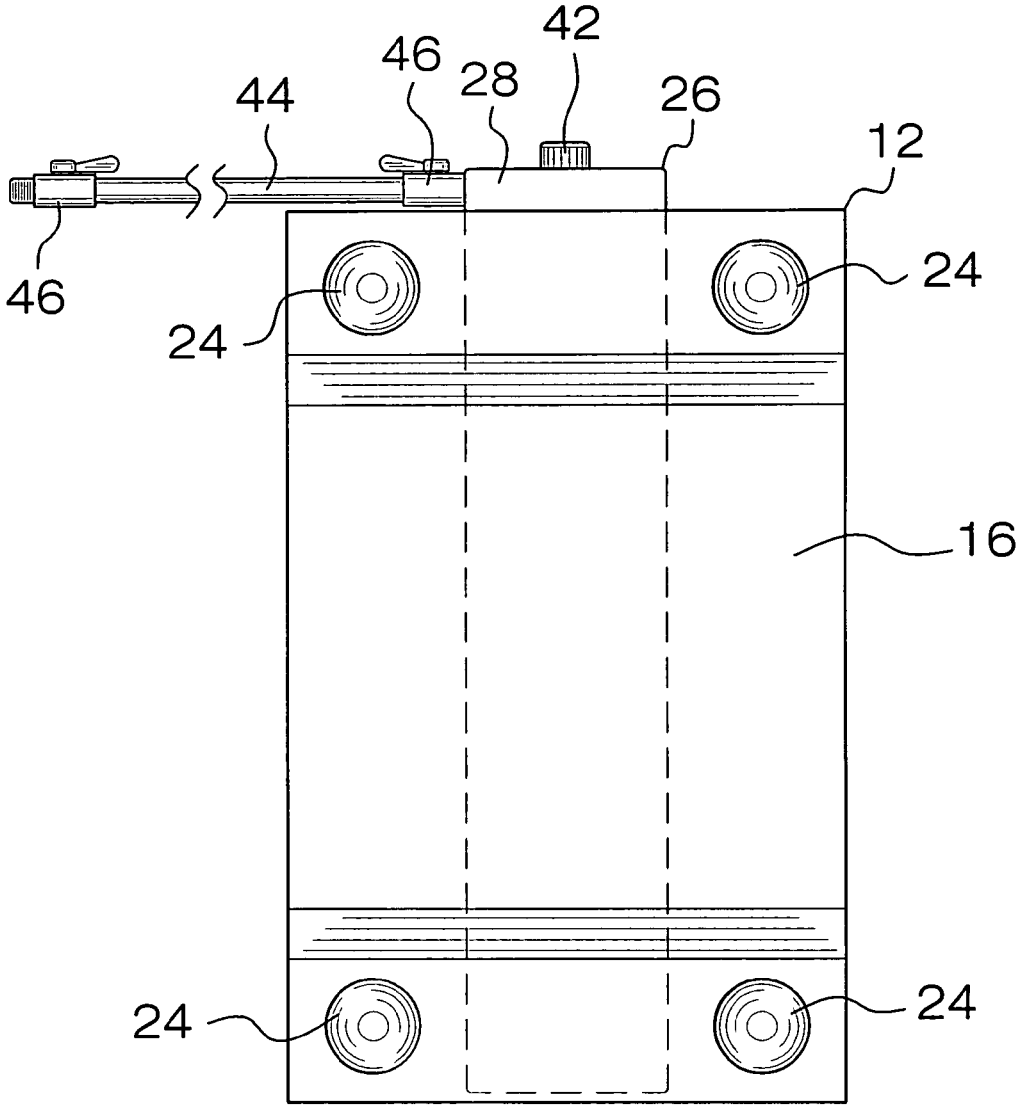
FIG. 4 is a rear view of the present invention.
Figure 5:
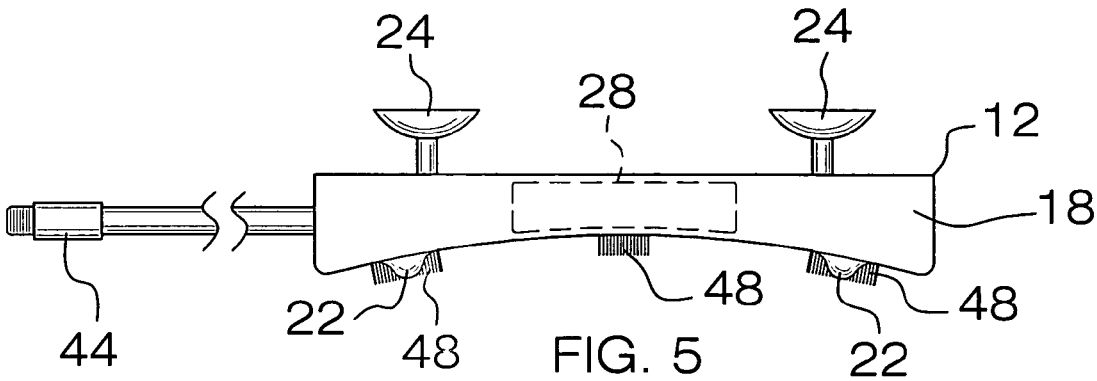
FIG. 5 is a bottom view of the present invention.
Figure 6:
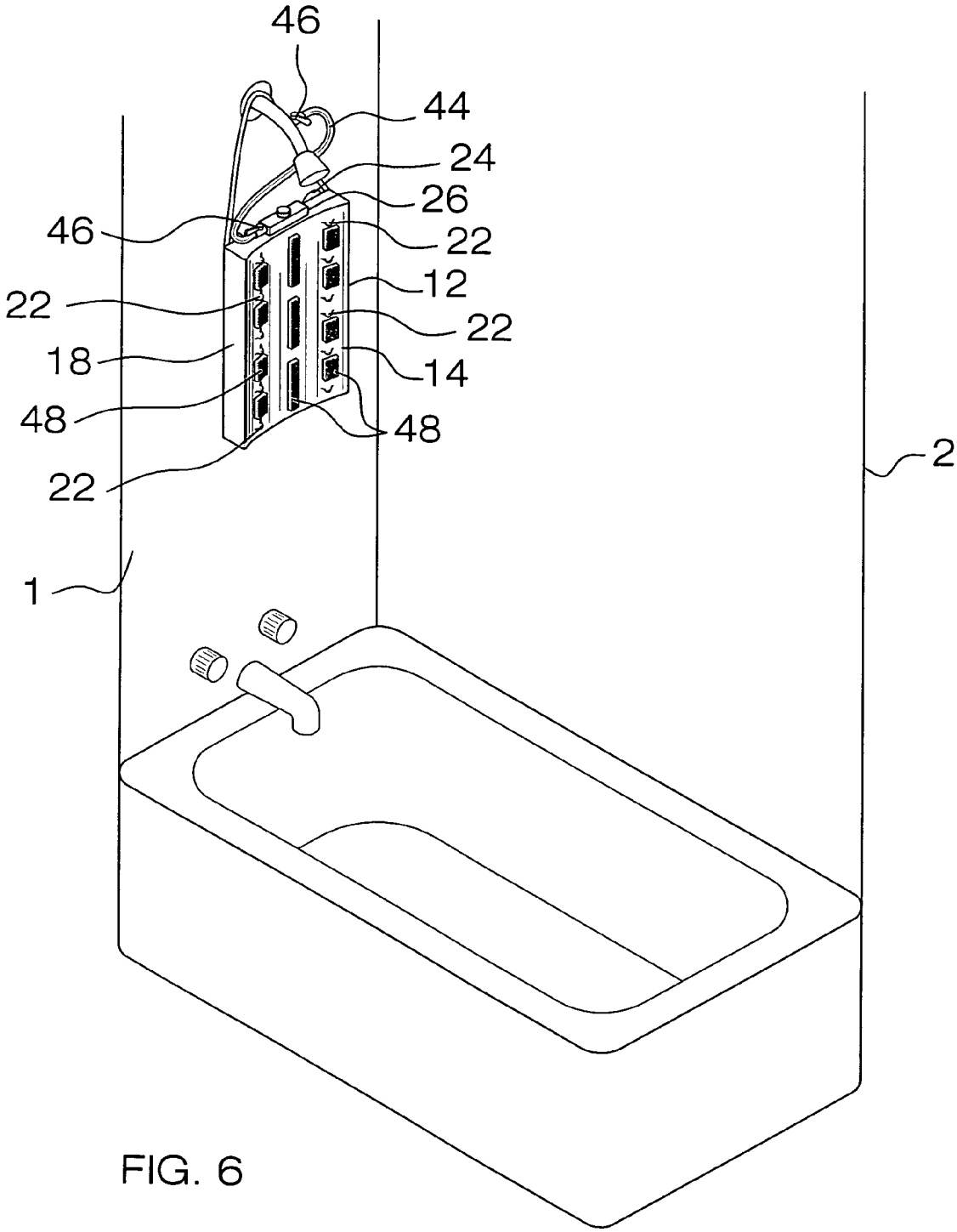
FIG. 6 is a perspective view of the present invention shown in place on a wall of a shower.

With reference now to the drawings, and in particular to FIGS. 1 through 6 thereof, a new shower back scrubber embodying the principles and concepts of the present invention and generally designated by the reference numeral 10 will be described.

As best illustrated in FIGS. 1 through 6, the back massaging and cleaning device 10 generally comprises a massager 12 having a front wall 14, a rear wall 16 and a perimeter wall 18 that extends between and is attached to the front wall 14 and the rear wall 16 to define an interior space 20. The front wall 14 has a concave arc to receive be contoured with a back of a person. The front wall 14 has a plurality of protuberances 22 extending outwardly from the front wall 14. The protuberances 22 are configured to be rubbed against the back to massage the back. Each of a plurality of suction cups 24 is coupled to the rear wall 16 and extends outwardly from the rear wall 16. Each of the suction cups 24 engages a wall 1 of a shower 2 and creates suction between the suction cups 24 and the wall 1 to mount the massager 12 to the wall 1.

A soap dispenser 26 is positioned in the interior space 20 of the massager 12. The soap dispenser 26 is configured to receive soap and is in fluid communication with a water source. The soap dispenser 26 supplies soap and water to the interior space 20 when the soap dispenser 26 receives water from the water source. A top end 28 of the soap dispenser 26 extends through the perimeter wall 18. The soap dispenser 26 includes a forward wall 30, a rearward wall 32 and a peripheral wall 34 extending between the forward wall 30 and the rearward wall 32 to define an inner space 36. The inner space 36 receives the soap. The forward wall 30 and the peripheral wall 34 have a plurality of apertures 38 extending therethrough. The apertures 38 permit water and soap in the inner space 36 to exit the soap dispenser 26 and enter the interior space 20 of the massager 12.

The soap dispenser 26 also includes a filling port 40 being coupled to the peripheral wall 34 adjacent the top end 28. The filling port 40 is in fluid communication with the inner space 36 to permit the soap to be added to the inner space 36. A cap 42 is coupled to the filling port 40 to selectively close the filling port 40 when the cap 42 is coupled to the filling port 40. A supply tube 44 is coupled to the peripheral wall 34 adjacent the top end 28. The supply tube 44 is couplable to a water source to permit fluid communication between the inner space 36 of the soap dispenser 26 and the water source. At least one flow valve 46 is coupled to supply tube 44 and is in fluid communication with the supply tube 44. The at least one flow valve 46 controls a flow of water through the supply tube 44 when the at least one flow valve 46 is actuated.

Each of a plurality of brushes 48 is coupled to the front wall 14 of the massager 12. Each of the brushes 48 is in fluid communication with the interior space 20 to permit soap and water in the interior space 20 to be applied to the back. The brushes 48 scrub the back when the front wall 14 receives the back. Each of the brushes 48 includes a base portion 50 coupled to the front wall 14 and is positioned adjacent an interior surface 52 of the front wall 14. The base portion 50 has a plurality of holes 54 extending therethrough to permit the soap and the water in the interior space 20 to exit the massager 12. A plurality of bristles 56 is coupled to the base portion 50. The bristles 56 extend through the front wall 14 to scrub the back. The holes 54 are interspersed between the bristles 56 to allow the soap and water to be applied to the bristles 56.

In use, the suction cups 24 are used to secure the massager 12 to a desired location on the wall 1. The soap dispenser 26 has soap inserted into the inner space 36 and the cap 42 coupled to the filling port 40. The at least one flow valve 46 is actuated to allow water from the water source to flow through the supply line and into the inner space 36 of the soap dispenser 26 to mix with the soap. The water and soap mixture passes through the apertures 38 in the soap dispenser 26 and into the interior space 20 of the massager 12. The water and soap mixture then passes through the holes 54 in the brushes 48 to the bristles 56. The person then rubs their back against the bristles 56 to scrub the back and the protuberances 22 to massage the back.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A back massaging and cleaning device for massaging and cleaning a back of a person showering, said device comprising:

a massager having a front wall, a rear wall and a perimeter wall extending between and being attached to said front wall and said rear wall to define an interior space, said front wall having a plurality of protuberances extending outwardly from said front wall, said protuberances being configured to be rubbed against the back to massage the back;

a soap dispenser being positioned in said interior space of said massager, said soap dispenser being configured to receive soap and being in fluid communication with a water source, said soap dispenser supplying soap and water to said interior space when said soap dispenser receives water from the water source; and a plurality of brushes, each of said brushes being coupled to said front wall of said massager, each of said brushes being in fluid communication with said interior space to permit soap and water in said interior space to be applied to the back, said brushes scrubbing the back when said front wall received the back.

2. The device according to claim 1, wherein said front wall has a concave arc to receive the back.

3. The device according to claim 1, further comprising a plurality of suction cups, each of said suction cups being coupled to said rear wall and extending outwardly from said rear wall, each of said suction cups engaging a wall of a shower and creating suction between said suction cups and the wall to mount said massager to the wall.

4. The device according to claim 1, wherein said soap dispenser has a top end extending through said perimeter wall.

5. The device according to claim 4, wherein said soap dispenser includes a forward wall, a rearward wall and a peripheral wall extending between said forward wall and said rearward wall to define an inner space, said inner space receiving the soap, said forward wall and said peripheral wall having a plurality of apertures extending therethrough, said apertures permitting water and soap in said inner space to exit said soap dispenser and enter said interior space of said massager.

6. The device according to claim 5, wherein said soap dispenser includes a filling port being coupled to said peripheral wall adjacent said top end, said filling port being in fluid communication with said inner space to permit the soap to be added to said inner space.

7. The device according to claim 6, wherein said soap dispenser includes a cap being coupled to said filling port to selectively close said filling port when said cap is coupled to said filling port.

8. The device according to claim 5, wherein said soap dispenser includes a supply tube being coupled to said peripheral wall adjacent said top end, said supply tube being couplable to the water source to permit fluid communication between said inner space of said soap dispenser and the water source.

9. The device according to claim 8, wherein said soap dispenser includes at least one flow valve being coupled to supply tube and being in fluid communication with said supply tube, said at least one flow valve controlling a flow of water through said supply tube when said at least one flow valve is actuated.

10. The device according to claim 1, wherein each of said brushes includes a base portion being coupled to said front wall and being positioned adjacent an interior surface of said front wall, said base portion having a plurality of holes extending therethrough to permit the soap and the water in said interior space to exit said massager.

11. The device according to claim 10, wherein each of said brushes includes a plurality of bristles being coupled to said base portion of the associated one of said brushes, said bristles extending through said front wall to scrub the back, said holes being interspersed between said bristles to allow the soap and water to be applied to the bristles.

12. A back massaging and cleaning device for massaging and cleaning a back of a person showering, said device comprising:

a massager having a front wall, a rear wall and a perimeter wall extending between and being attached to said front wall and said rear wall to define an interior space, said front wall having a concave arc to receive the back, said front wall having a plurality of protuberances extending outwardly from said front wall, said protuberances being configured to be rubbed against the back to massage the back;

a plurality of suction cups, each of said suction cups being coupled to said rear wall and extending outwardly from said rear wall, each of said suction cups engaging a wall of a shower and creating suction between said suction cups and the wall to mount said massager to the wall;

a soap dispenser being positioned in said interior space of said massager, said soap dispenser being configured to receive soap and being in fluid communication with a water source, said soap dispenser supplying soap and water to said interior space when said soap dispenser receives water from the water source, a top end of said soap dispenser extending through said perimeter wall, said soap dispenser comprising;

a forward wall, a rearward wall and a peripheral wall extending between said forward wall and said rearward wall to define an inner space, said inner space receiving the soap, said forward wall and said peripheral wall having a plurality of apertures extending therethrough, said apertures permitting water and soap in said inner space to exit said soap dispenser and enter said interior space of said massager;

a filling port being coupled to said peripheral wall adjacent said top end, said filling port being in fluid communication with said inner space to permit the soap to be added to said inner space;

a cap being coupled to said filling port to selectively close said filling port when said cap is coupled to said filling port;

a supply tube being coupled to said peripheral wall adjacent said top end, said supply tube being coupable to the water source to permit fluid communication between said inner space of said soap dispenser and the water source;

at least one flow valve being coupled to supply tube and being in fluid communication with said supply tube, said at least one flow valve controlling a flow of water through said supply tube when said at least one flow valve is actuated;

a plurality of brushes, each of said brushes being coupled to said front wall of said massager, each of said brushes being in fluid communication with said interior space to permit soap and water in said interior space to be applied to the back, said brushes scrubbing the back when said front wall received the back, each of said brushes comprising;

a base portion being coupled to said front wall and being positioned adjacent an interior surface of said front wall, said base portion having a plurality of holes extending therethrough to permit the soap and the water in said interior space to exit said massager; and a plurality of bristles being coupled to said base portion, said bristles extending through said front wall to scrub the back, said holes being interspersed between said bristles to allow the soap and water to be applied to the bristles.

* * * * *